US005412891A

United States Patent [19]

Black et al.

[11] Patent Number: 5,412,891

[45] Date of Patent: May 9, 1995

[54] CHANGEABLE SIGN

[75] Inventors: F. Martin Black, Greensboro; Steven H. Brenia, Kernersville; G. Frank Dye, Greensboro, all of N.C.

[73] Assignee: FMB Communications, Inc., Greensboro, N.C.

[21] Appl. No.: 28,889

[22] Filed: Mar. 10, 1993

[51] Int. Cl.[6] ..... G09F 3/00

[52] U.S. Cl. ..... 40/447; 40/449

[58] Field of Search ..... 40/447, 473, 492, 463, 40/446, 470; 340/764, 815.26, 815.27, 815.29

[56] References Cited

U.S. PATENT DOCUMENTS

| | | |
|---|---|---|
| 3,482,344 | 0/1969 | Holloman . |
| 3,706,148 | 0/1972 | Johnston . |
| 3,949,392 | 0/1976 | Caritato . |
| 4,417,241 | 0/1983 | Wakatake . |
| 4,466,207 | 0/1984 | Salam . |
| 4,597,209 | 0/1986 | Hukill . |
| 4,761,905 | 0/1988 | Black . |
| 4,769,638 | 0/1988 | Woolfolk . |
| 4,912,442 | 0/1990 | Black . |
| 5,057,828 | 0/1991 | Rousseau . |

*Primary Examiner*—Kenneth J. Dorner
*Assistant Examiner*—Cassandra Davis
*Attorney, Agent, or Firm*—Rhodes, Coats & Bennett

[57] ABSTRACT

A changeable sign display has a supporting frame for an array of pixel elements including planar supports for the pixel elements perpendicular to the axes of rotation. Leaf springs extend from the supports toward the axis of rotation. Wires pass through aligned holes in the supports and leaf springs to serve as axles for the pixel elements. Upper and lower mountings for the planar supports are adjustable to correct bowing of the planar supports to assure sufficient coplanarity of the pixel elements to permit their selective rotation. The pixel elements have first and second ramp elements which are different from one another and facets which are different. The pixel element facets are supported from a hub which has flat outer faces which contact the leaf springs to restrain the pixel element from rotation and a slot extending along its length to permit the hub to be positioned over an axle support. A carriage supports a movable activator bank located rearward of the pixel elements. Ganged reset arms reset all pixels to a common display and a solenoid bank has activatable solenoid rods to selectively contact ramp elements to set selected pixel elements to a selected display as the solenoid bank passes rearward of the pixel elements, and a drive apparatus moves the carriage to and fro behind the array.

24 Claims, 4 Drawing Sheets

FIG. 1
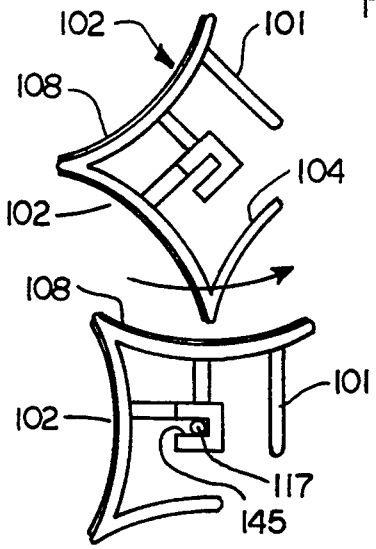
FIG. 2
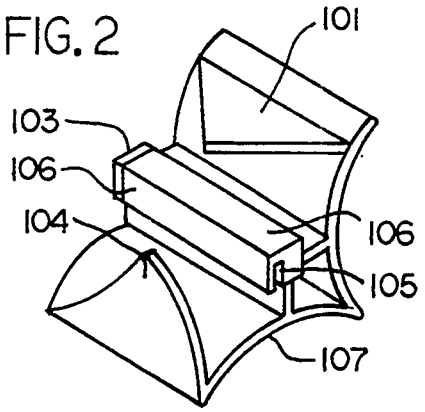
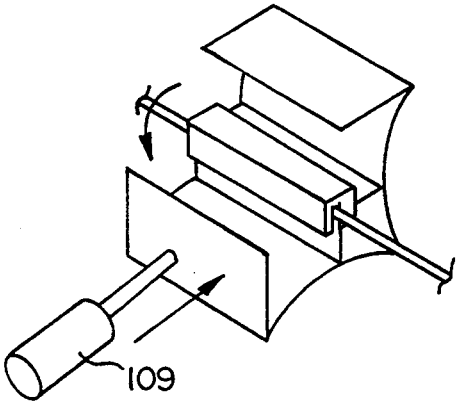
FIG. 3
FIG. 5
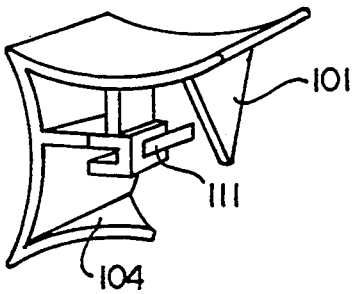
FIG. 4
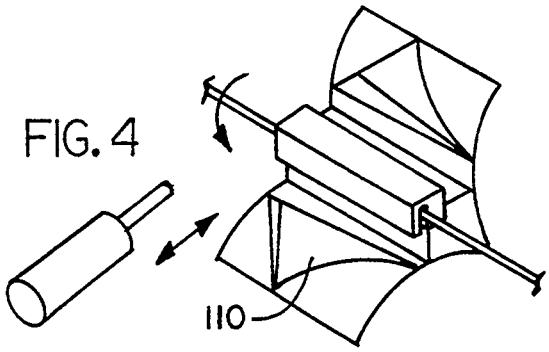
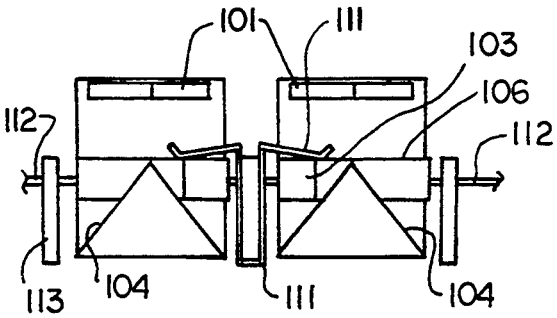
FIG. 6
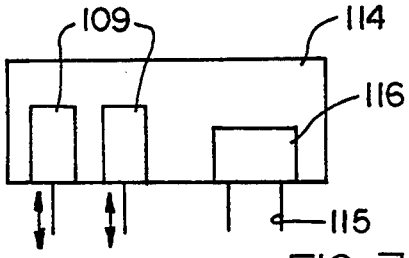
FIG. 7
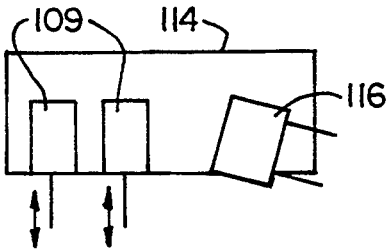
FIG. 8

FIG. 9
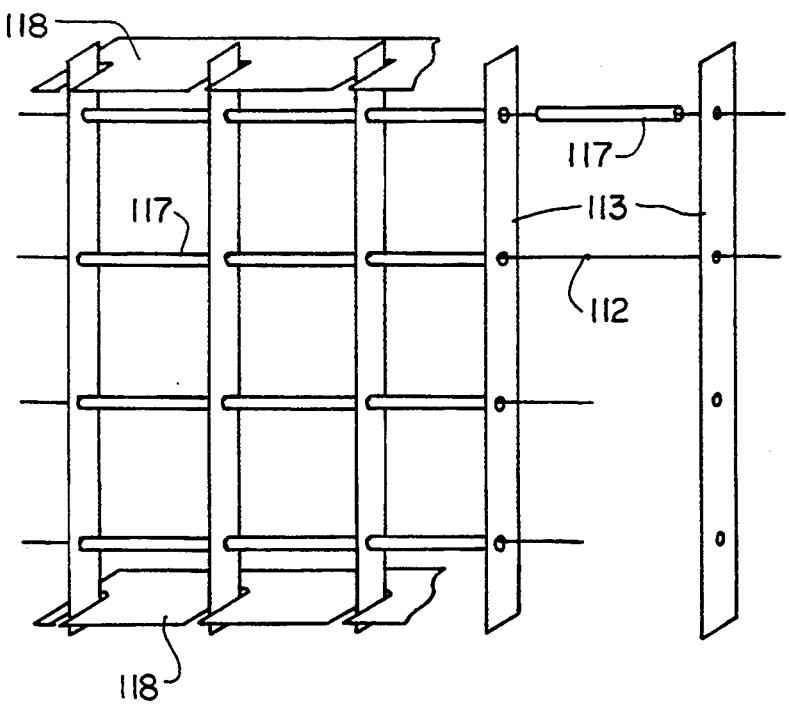
FIG. 10
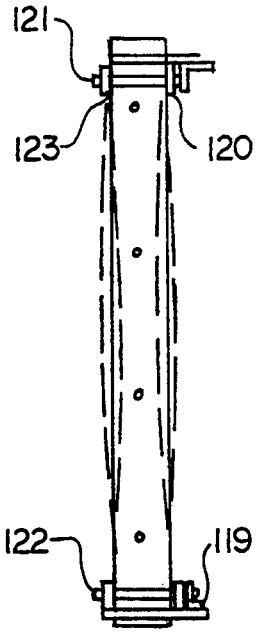
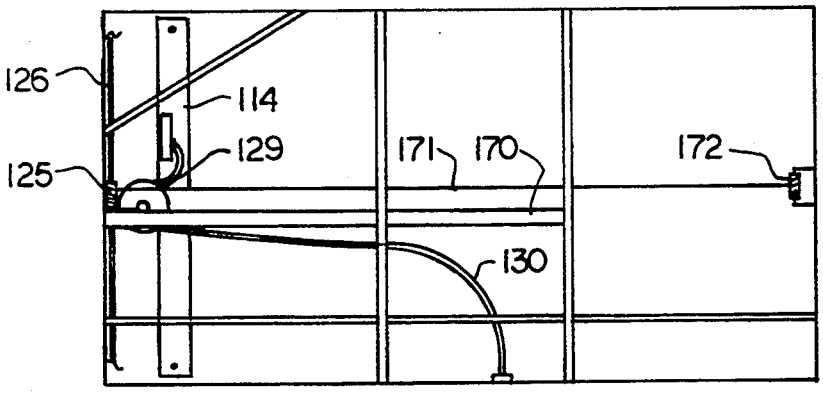
FIG. 12
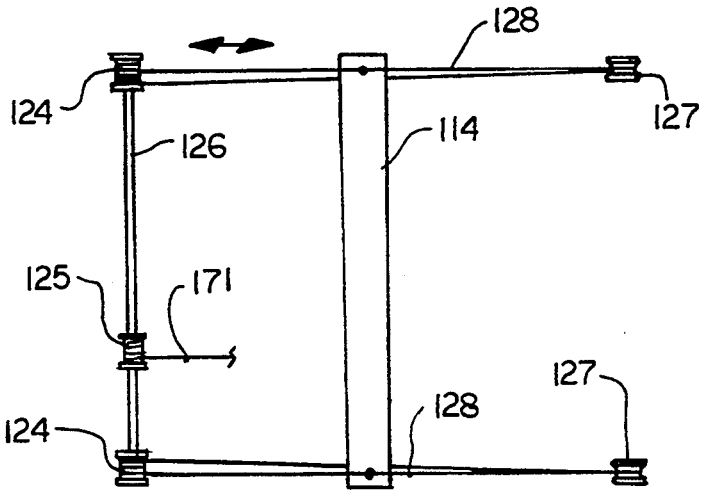
FIG. 11

CHANGEABLE SIGN

BACKGROUND OF THE INVENTION

The present invention relates to improvements in changeable signs. One of the inventors of this application, Fred M. Black, is the inventor of U.S. Pat. No. 4,761,905 entitled "Scanned Electromechanical Display" and U.S. Pat. No. 4,912,442 entitled "Scanned Electromechanical Alphanumeric Display". The disclosures of both these patents are hereby specifically incorporated herein by reference. The present invention relates to improvements on the changeable sign disclosed in those patents. The patents disclose sign elements which can display alphanumeric or graphic images on a pixel-by-pixel basis, generally arranged in a rectangular grid. The pixels are made up of solid elements having multiple sides of contrasting appearances, so that the display of one side or the other is noticeable. The overall pattern made up by the collection of pixel elements makes a perceived image, whether of an alphanumeric character, a graphic image, or the like. The prior patents disclosed arrays of such pixel elements and devices which pass behind the arrays to pivot the pixel elements to selectively display one or the other of the contrasting sides. The present invention has that notion in common, but provides improved design features to reduce the cost, enhance the picture quality, and enhance the reliability of the sign.

One of the important elements in making signs of this type is to provide as large as possible a mark-to-space ratio. That is, for each perceptible pixel size, as much as possible of the size should be displayed as the mark or distinctive appearance rather than an unchanging border. The present invention provides features which enhance the mark-to-space ratio over the prior art.

These features were not provided by the prior art, therefore leaving a need for improvements.

SUMMARY OF THE INVENTION

The present invention fulfills this need in the art by providing a changeable sign display having an array of pixel elements rotatable about wherein the facets of the pixel elements are cylindrically concave, with the axis of the cylinder of concavity being parallel with the axis of the rotation for the pixel element. First and second ramp elements on the pixel elements are positioned opposite the facets, the first and second ramp elements having different configurations so that the orientation of the pixel elements in a hand may be determined by touch. In one embodiment one of the configurations resembles the hull of a bow of a boat. Preferably, the pixel elements are made of acetal resin. The facets may be identical except for a label adhered to one of them.

In a preferred embodiment the pixel element facets are supported from a hub, the hub having flat outer faces serving as detent surfaces. The hub has a slot extending along its length to permit the hub to be positioned over an axle support. Typically, the hub slot has an inner retainer to hold the pixel element on the axle.

The array may include supports for the pixel elements perpendicular to the axes of rotation with the pixel element facets supported from hubs on axles passing through the supports, the hubs having an extension beyond the facets to act as a bearing against adjacent supports. Preferably, leaf springs extend from the supports toward the axis of rotation of the pixel elements and the hubs have outer faces inward of the facets which are flat and contact the leaf springs to restrain the pixel pixel element from rotation. In a preferred embodiment at least one of the leaf springs has portions integrally formed with similar portions of leaf springs for upper and lower ones of the pixel elements. Also preferred is for the leaf springs to have portions integrally formed with similar portions of leaf springs for laterally adjacent ones of the pixel elements.

In a preferred embodiment the supports for the pixel elements and leaf springs have aligned holes, and axles for the pixel elements pass through the aligned holes. The supports are preferably planar and wires pass through the supports to serve as axles for the pixel elements. In a preferred embodiment the wires are provided with sleeves between adjacent planar supports to space the supports from one another and to serve as bearings for the pixel elements. Alternatively, the wires may be secured to the planar supports to and lower mountings with at least one of the mountings being adjustable to correct bowing of the planar support to assure sufficient coplanarity of the pixel elements to permit their reliable selective rotation.

The invention also provides a changeable sign display having an array of pixel elements rotatable about axes with facets selectively displayable in one or the other of two modes and first and second ramp elements on the pixel elements opposed to the facets, with a movable activator bank located rearward of the pixel elements including ganged reset arms to reset all pixels to a common display and a solenoid bank having activatable solenoid rods to selectively contact ramp elements to set selected pixel elements to a selected display as the solenoid bank passes rearward of the pixel elements. Preferably, the movable activator bank includes a carriage supporting the ganged reset arms for selective pivoting between first and second positions, the first position being such that movement of the ganged arms resets the pixels and the second position being such that movement of the ganged arms does not reset the pixels. Preferably, apparatus for pivoting the ganged arms from the first to the second position is a located near one extreme of carriage travel and from the second to the first is located near the other extreme of carriage travel.

The invention also provides a changeable sign display having an array of pixel elements rotatable about axes with facets selectively displayable in one or the other of two modes with a movable activator bank located rearward of the pixel elements and a motive means for the movable activator bank to move the bank to and fro rearward of the array of pixel elements to display selected pixel elements as the bank passes rearward of the pixel elements. The motive means includes a pair of pulleys on one end of the array, a shaft on the other end having a pair of spools fixed on the shaft and a motor to rotate the shaft, and a pair of cables, each having its two ends affixed to one of the spools, wraps around the spool, a fastening to the movable activator bank and a loop around one of the pulleys. Thus, rotation of the shaft by the motor in a first direction pays out and retrieves cable from the spools to urge the movable activator bank to one end of the array, and rotation of the shaft by the motor in a second direction pays out and retrieves cable from the spools to urge the movable activator bank to the other end of the array.

Preferably, an electrical cable extends to the activator bank from a connection and a retriever for the electrical cable is provided including an additional pulley on one end of the array, a support across the array supporting a retriever pulley around which the electrical cable is trained, a smaller spool fixed on the shaft of a diameter less than the diameter of the spools of the pair, and a retriever cable having its two ends affixed to the smaller spool, wraps around the smaller spool, a fastening to the retriever pulley and a loop around the additional pulley. Rotation of the shaft by the motor in a first direction pays out and retrieves cable from the smaller spool to urge the retriever pulley from one end of the array to a central position, and rotation of the shaft by the motor in a second direction pays out and retrieves cable from the smaller spool to urge the retriever pulley to the end of the array.

Alternatively, a signal connection to the movable bank may include a first optical transceiver at an end of the array and a second optical transceiver on the movable bank. An alternate electrical power supply to the movable bank may have a connection to at least one of the cables with the spools being insulated from the power supply. Another electrical power supply to the movable bank may include a connection to the bank through rails along which the bank travels. Yet another electrical power supply to the movable bank, may take the form of a rechargeable battery on the bank and battery recharging connection at one end of the array to recharge the battery during periods when the sign is not being changed.

BRIEF DESCRIPTION OF THE DRAWINGS

The invention will be better understood from a reading of the detailed description of a preferred embodiment along with a review of the drawings in which:

FIG. 1 is a side view of two pixel elements, one in transition from one display orientation to another;

FIG. 2 is a perspective view of a pixel element according to a preferred embodiment;

FIG. 3 is a perspective view of an alternative embodiment of a pixel element with an activator;

FIG 4 is a perspective view of another embodiment of a pixel element with another activator;

FIG. 5 is a perspective view of the first embodiment of a pixel element with a retention spring;

FIG. 6 is a top plan view of two, side-by-side pixel elements with a ganged spring;

FIG. 7 is a top plan view of a carriage illustrating the solenoids in the set position and the reset arms in the active position;

FIG. 8 is a top view of the carriage illustrating the solenoids in the set position and the reset arms rotated out of the way;

FIG. 9 is an exploded perspective view of the grid support arrangement;

FIG. 10 is a side schematic view of adjustment mechanisms for the grid of FIG. 9;

FIG. 11 is a schematic view of the carriage travel mechanism;

FIG. 12 is a schematic view of the cable retriever mechanism;

DETAILED DESCRIPTION OF A PREFERRED EMBODIMENT

Figure 17:
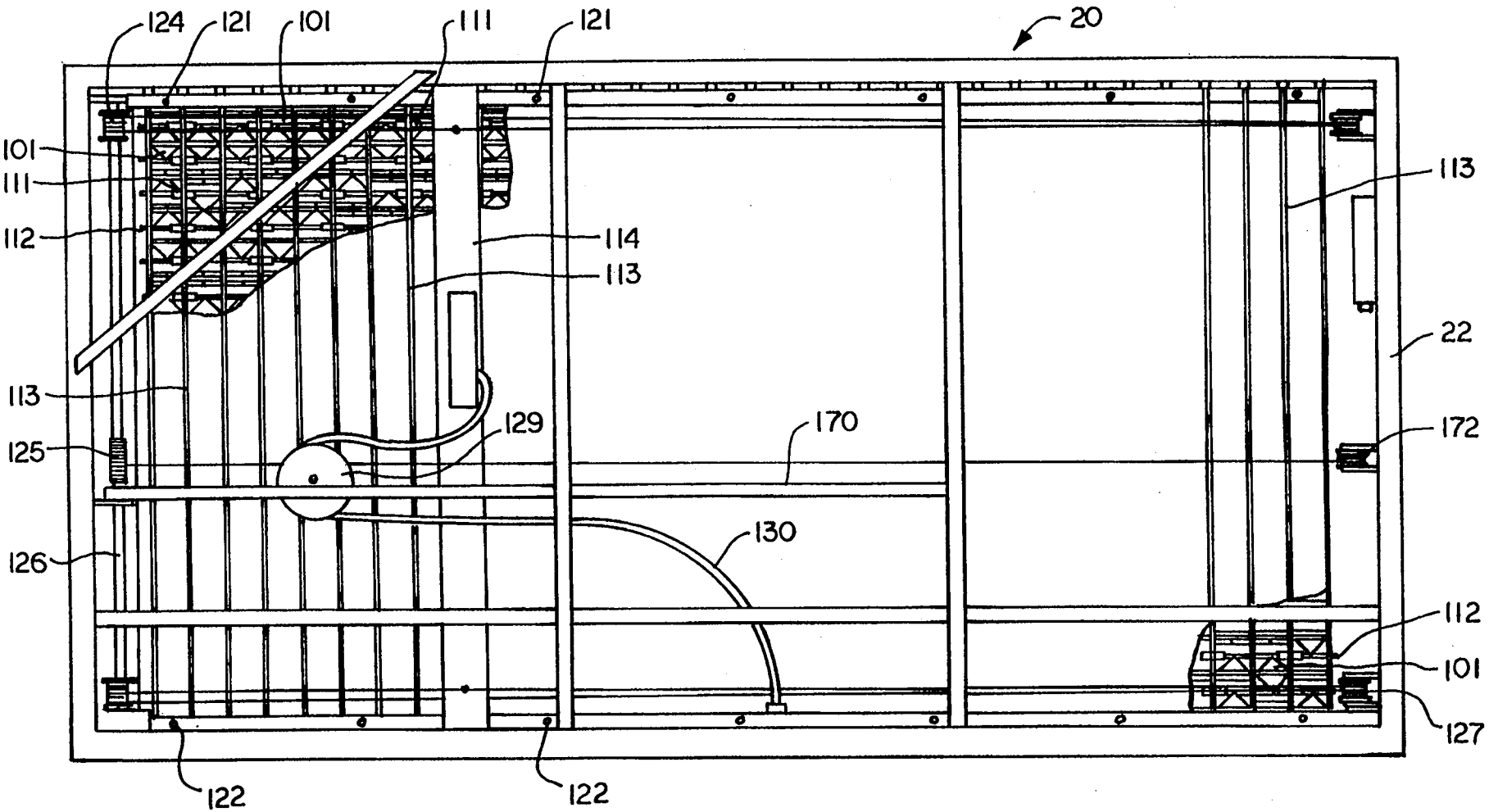
FIG. 17 is a rear elevation view of the various sign components.

Referring first to FIG. 17, which is an abbreviated, small size sign 20, there can be seen a multiplicity of pixel elements 107 arrayed in rows and columns. The number of pixel elements shown in the sign 20 is fewer than are generally used in a typical sign for simplicity, although the number used is not critical. Obviously, the more pixel elements and the smaller their size, the operative components can be seen. From the front, the view is of the pixel element showing one or the other of two faces, making up the sign image. The various components shown in FIG. 17 are discussed in more detail with respect to individual figures showing each component.

The sign includes a peripheral frame 22 having located within it a plurality of vertically extending planar support elements 113. These support elements are thin sheets of metal, with the plane of the sheet being perpendicular to the plane of FIG. 17. Passing through aligned holes in the plurality of sheets 113 are a plurality of wires 112 extending right-to-left across FIG. 17. The pixel elements 107 are mounted on sleeves surrounding the wires 112. The sleeves are provided of a length long enough to maintain the separation of the supports 113 and also act as bearings for the rotation of the pixel elements 107.

The pixel elements 107 have hub portions which have flat sides 106. The flat sides have leaf springs 111 which are extensions of the spring elements held in place by through-extending wire 112 as shown in FIG. 6 and which bear against to restrain them from rotation. However, with exertion of a sufficient rotational force on the pixel elements 107, they can be induced to rotate, overcoming the leaf spring force, until another flat side of the hub is contacted by the leaf spring and therefore stabilizes it in a desired orientation. The pixel elements 107 have two sides which are used for the sign display and the rotations are back and forth to display one or the other side.

The pixel elements are induced to rotate by the contacting of ramp portions 101 of the pixel elements as seen in FIG. 17 by retractably projecting pins on a moving carriage 114. The pins cannot be seen in FIG. 17, but project from the carriage toward the ramps 1 01 of the pixel elements to convert linear motion of the carriage into rotational motion of the pixel elements, under computer control.

The carriage 114 is induced to move from side-to-side across the back of the array of pixel elements through a driven cable, as will be discussed more fully hereinbelow. A signal and power supply cable 130 is connected from the frame 22 to the carriage 114 to convey signalling information to the solenoids controlling the set pins on the carriage 114. A retriever pulley 129 distance of the array under a cabling system, also to be discussed hereinbelow.

Pixel Elements

The pixel elements use the ramp principle to convert linear motion to rotary motion. The pixel element 107 shown in FIGS. 1 and 2 has curved faces 102 instead of flat faces. This allows the pixel elements 107 to be placed closer together, which results in an improved mark to space ratio. Curved faces on pixel elements are shown in U.S. Pat. No. 5,057,828 to Rousseau. The ramps are also located somewhat inward to maintain the clearance, like the curvature of the facets. Rather than moving both ramps inward, one flat ramp 101 is provided flat and set in, while curving the other ramp 104 with the same curvature as the visible faces. This provides unique surfaces for positioning during application of label 108, simplifying the labelling process and preventing the pixel element from being placed in the label machine and sign incorrectly. Using labels provides an inexpensive method of generating contrasting colors on the pixel elements. The pixel element can also be dyed in conjunction with labels or made as a two-part system with different color faces.

The pixel element 107 has an axle slot 105 rather than a hole, allowing snap-in assembly and removal from the front of the sign without any special tools or having to disassemble the grid.

The hub of the pixel element 107 also has an extension 103 on one side which acts as a bearing surface and spacer and prevents the faces from hitting the vertical support when the pixel element rotates. This bearing surface could be on both sides for symmetrical operation or could be replaced by separate spacers.

The pixel element 107 also has a molded in flat surface 106 for the detent spring 111.

The pixel element 107 is molded out of a material (Acetal) that is self-lubricating and dimensionally stable in a wide range of outdoor conditions. The self-lubricating nature is especially important when the linear motion of the set and reset arms contact the ramps to rotate the pixel elements. Other be molded in many base colors, with our preferred color being white. The second color is applied by a label 108 with pressure sensitive adhesive, which adheres to one (or both) faces of the pixel element. Two labels may be applied to the respective faces to provide a two-color selection if the base material cannot be molded out of a desired color. Dyeing or painting the pixel elements or faces of the pixel element is another option. Alternate ramp and set/reset pin designs are illustrated in FIGS. 3 and 4. They include a ramp 110 surface shaped like the bow of a boat hull which rotates when struck by a laterally moving pin. Another option is to position the solenoid so when it fires it actually flips the pixel element so the solenoid timing is not as critical when using this design. A drawback of this design is that it generates a backwards force on the solenoid push rod, requiring a solenoid with a stronger activating force when compared to the preferred embodiment.

Spring Design

U.S. Pat. No. 4,912,442 illustrates several methods of detents including a leaf type spring 111. The patent indicated the spring was in line (or tangent) to the motion of the pixel element. We discovered that this makes the position of the pixel element dependent on the force and position of the spring. With the close tolerances required, interference between vertically adjacent pixel elements could occur, resulting in jams. By placing the spring perpendicular to the rotation of the pixel element (parallel to the axis of rotation), the pixel element position no longer depends on the preloading or strength of the spring (FIG. 5).

The preferred spring component has 16 leaf type positions and is designed to straddle the vertical supports (only one pair of the eight being illustrated in FIG. 6). That is, the component straddles the vertical support and has eight vertically spaced springs on each side of the support. Position accuracy is important to ensure that each pixel element has the same force applied. That is accomplished by using holes in the spring component that fit over the same axle 112 used for the pixel elements. This assures that the spring position is both accurate and repeatable with respect to the pixel elements.

The spring can be provided as singles, banks of twos or multiple banks. The sign is built in lines consisting of 8 rows each, and a bank of 16 springs, supports two horizontally adjacent pixel elements in a line of 8 rows. Symmetrical banks of eight pairs are desirable, due to the thinness of the vertical supports (intentionally made thin so the pixel elements can be spaced closely together). Torquing of the supports may occur when the carriage scans and sets or resets the pixel elements. The torquing causes interference when the pixel elements rotate. By using a symmetrical spring system, on alternate supports (as seen in FIG. 6), the opposite spring applies pressure and reduces/or eliminates the torquing tendency. With thicker vertical supports, single spring banks could be used on each vertical support. The springs could also be molded into each pixel and act against a detent feature incorporated into the grid.

Set Solenoids

Our previous patents indicated an escapement mechanism that provided either a set or reset condition. The present design uses solenoids 109 as shown in FIG. 4 that provide only a set condition when activated. Solenoids are activated when the solenoids are between the pixel elements (on the fly). This allows a significant reduction of the force required of the solenoids, since they now have only to move their own plunger or pin. This permits use of smaller, lower cost and higher reliability solenoids. The force on the solenoid to set the pixel elements is perpendicular to the movement of the plunger and only occurs after the plunger is out.

As in the previous patents, the solenoids are staggered to activate even and odd rows separately. Again this allows closer vertical spacing.

Alternative to using the linear-to-rotary motion conversion of the ramp, the solenoids could actually flip the pixel elements by activating when behind the pixel element, as shown in FIG. 3. The disadvantage is that the solenoid must provide enough force to flip the pixel element. Air pressure and electromagnetic force are other options, however, using an electromagnetic impulse would require either a magnet or ferrous metal to be part of each pixel element.

Using a set only solenoid 109, without an escapement, requires a separate reset system. One alternative was to duplicate the set solenoids and position them so they would reset the pixel elements when activated. A disadvantage was the doubling in number of solenoids.

A second approach is to build a bank 116 of fixed reset arms 115, staggered on a movable assembly (reset bar mechanism). The assembly can be moved out of the way so the pixel elements are not reset when such is desired. When the assembly is in the reset position, all pixel elements are reset as the carriage scans by.

The reset bar mechanism can be moved in and out in a linear or rotary fashion by a small activator (motor, solenoid) controlled by the software. We elected to use an over center toggle system that mechanically moves the reset bar out of position when the carriage is retracting. When the carriage reaches the end of the scan cycle at the end of the sign, a rod hits a stop and causes the reset bar to toggle out of the way.

When the carriage completes the retrace cycle, the other end of the rod hits a stop that toggles the reset bar into the reset position. As the carriage scans, the reset bar resets all pixel elements to be a common orientation, the set solenoids selectively set pixel elements and a bank of optional sensors scan the pixel elements for position verification.

Grid Design

The grids (pixel element support structure) illustrated in U.S. Pat. No. 4,912,442 were expensive to produce and added unwanted spaces between the pixel elements. Our objective was to produce a display that was dense (a high mark to space ratio). An alternative, shown in FIG. 9, is to utilize very thin vertical support 113 connected together with axle wires 112 that run the length of the sign. The spacing of the vertical supports at the top and bottom are determined by metal grid plates 118. Each horizontal wire acts as an axle support for spacing tubes 117. The tubes also act as axles for the pixel elements. Alternatives would be to score the wires and use "C" or "E" rings. Another alternative would be to deform the wire at specific intervals. Still another approach would be to assemble the whole grid and braze, weld, the support and axles together.

Grid Adjustments

The vertical supports 113, axle wires 112, and spacer tubes 117 comprise the grid system in our preferred embodiment. Since the spacing between the pixel element ramps on the grid, set and reset arms on the carriage is critical, a series of adjustments along the top and bottom of the grid assembly are provided. These adjustments could be eliminated by specifying significantly tighter tolerances on the parts comprising the grid and grid supports, however, there could be a significant cost penalty.

As seen in FIG. 10, the grid adjustment consists of tightening or loosening a series of clamp screws 122 and jack screws 121. The clamp screws 122 and grid clamps 123 holds the vertical supports in place while the jack screws 121 and jack plate 120 move the center of the supports in and out. The jack plate is threaded, and tightening the jack screw against the grid support angle 119 pushes the jack plate out and the vertical support out. These adjustments eliminate (or reduce) bowing of the vertical supports.

Drive System

As seen in FIG. 11, the drive system includes a single motor rotating a shaft 126. The shaft has spools 124 at the top and bottom to which cables 128 are tightly wound. The cables are also threaded through pulleys 127 at the far end for holding the cables taut.

The motor rotation in one direction unwinds the cable from the top of each spool while it winds the cable on the bottom of each spool, resulting in a positive linear movement of the cable between the spool and pulley. When the motor reverses, the sequence reverses. The cables from each spool are also tightly fastened to the carriage 114, so linear movement of the cables (at the top and bottom) moves the carriage forward and back. Since the cables are secured at each end and to the carriage, the position of the carriage is totally dependent on the position of the cables and does not depend on friction to maintain position.

Cable Retriever

The cable retriever pulley 129 system for the signal/power cable 130 shown in FIG. 12 uses the same drive system as the carriage but runs half the one half the diameter of the spools 124. A cable retriever pulley 129 rides on a track 170 and is driven by a retriever cable 171 affixed like the cables 128 to spool 125 and a distal pulley 172. When the carriage is at the far left end, the retriever is in line with the carriage. When the carriage is at the near right end, the retriever is at the halfway mark. When the carriage is in the center, the cable retriever is halfway between the left end and the carriage. The sum of the distances from carriage to the retriever and the retriever to the termination remains a constant, thereby ensuring that the signal/power cable 130 has appropriate tension.

Other approaches are feasible, such as a cable hanger and roller system spring type cable tensioners, however, the preferred system maintains the cable movement in a linear rolling fashion thereby reducing height requirements and equalizing any concentrated stress due to bending.

Alternative Power/Signal Connections

Figure 13:
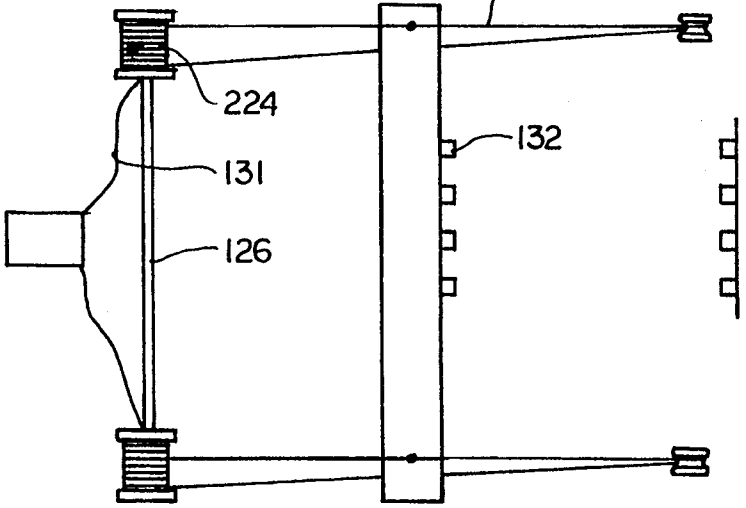

The power and signals to the carriage are transmitted through a multi-conductor flexible cable 130, hence the need for the cable retriever assembly and expensive cable. An alternative approach to simplify the system would be to utilize the drive cables 128 for power, which would require a power take-off between the spools and power supply and insulating the spools 224 (FIG. 13). A wireless system (optical, ultrasonic or RF transceivers 132) for the signals would provide communication between the controller on the frame and the driver on the carriage.

Figure 14:
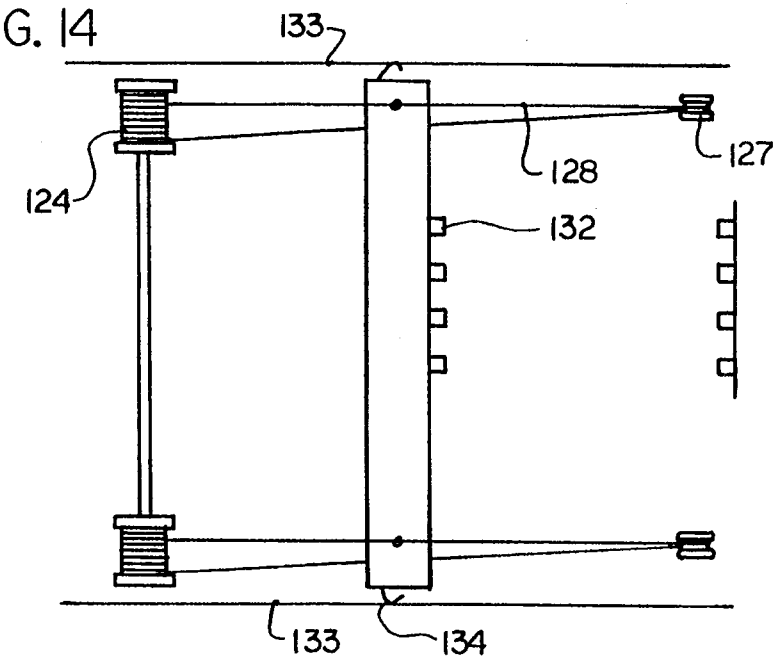
FIGS. 13, 14 and 15 are similar to FIG. 11, but showing alternate power and signal input arrangements.

A second alternative would be to use rails 133 as power busses or separate busses and utilize power pick-offs much like a trolley system (FIG. 14).

Figure 15:
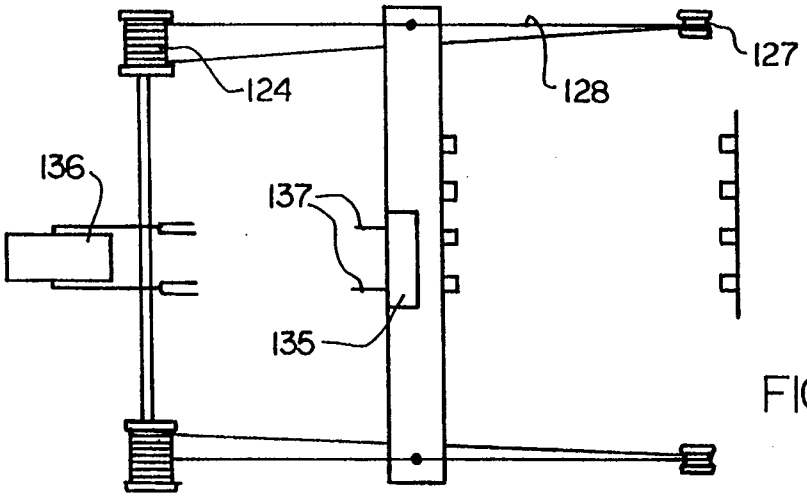

The third alternative would place a rechargeable battery 135 on the carriage to provide carriage power. When the carriage is at the home position, the battery mates with a charging power supply 136 through connection 137. Since the carriage runs intermittently and is mostly in the home position, the charging system would maintain a full charge on the battery (FIG. 15).

Power Supply

The sign system can draw average currents that exceed 10 amps, on an intermittent basis that will not exceed 20 seconds/minute. The power supply is designed to deliver peak currents in excess of 10 amps for less than 60 seconds and shut down if the current draw exceeds the 60 seconds. Exceeding 8 amps in 60 seconds is a fault condition, and the power supply folds back. Power to the supply must be removed for at least 20 seconds for the supply to again operate. This fold-back system is a safety feature that allows the sign to maintain intermittent operation while preventing any fault condition from causing a potential fire or safety hazard.

Figure 16:
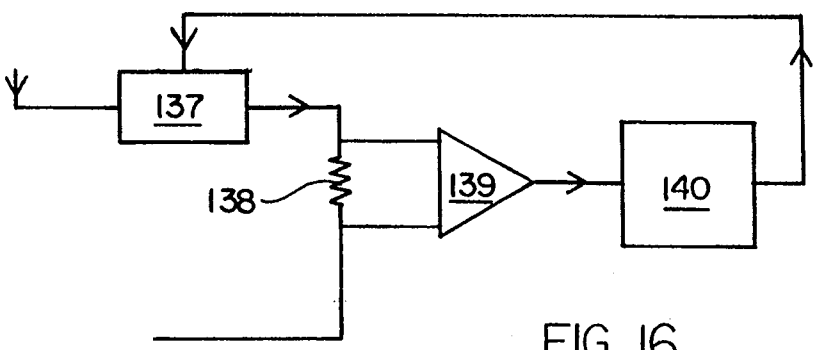
FIG. 16 is a schematic diagram of a power supply regulator circuit for the sign.

As seen in FIG. 16, the sense circuit 139 consists of a comparator that monitors the voltage difference on a current sense resistor 138. The comparator is adjusted to trip when the voltage difference is the product of the sense resistance times 8 amps. When the comparator trips, it starts a timer 140 that folds back the regulators 137 if the current does not decrease to below 8 amps during a predetermined time. Any time the current decreases to below 8 amps, the time is reset and is not set again until the 8 amp threshold is reached. Sixty seconds and 8 amps are used to meet the specific UL requirements for signs, however, other currents and times may be used to satisfy other design and regulatory requirements.

When input power is reapplied, the system will return to normal operation.

Those of ordinary skill in the art will appreciate that the invention can be carried out in various forms other than those specifically shown, and these are deemed to be within the scope of the claims. Also, various combinations and subcombinations of the features can be used without going beyond the scope of the invention.

What is claimed is:

1. A changeable sign display having an array of pixel elements rotatable about axes with facets selectively displayable in at least one of two modes wherein said facets of said pixel elements are cylindrically concave, with the axis of the cylinder of concavity being parallel with the axis of the rotation for said pixel element and first and second ramp elements on said pixel elements opposed to said facets, said first and second ramp elements having different configurations so that said orientation of said pixel element may be determined by touch.

2. A sign as claimed in claim 1 wherein one of said configurations resembles the hull of a bow of a boat.

3. A sign as claimed in claim 1 wherein said pixel elements are made of acetal resin.

4. A sign as claimed in claim 1 wherein said facets are identical except for a label adhered to one of them.

5. A sign as claimed in claim 1 wherein said pixel element facets are supported from a hub, said hub having flat outer faces serving as detent surfaces.

6. A sign as claimed in claim 1 wherein said pixel element facets are supported from a hub, said hub having a slot extending along its length to permit the hub to be positioned over an axle support.

7. A sign as claimed in claim 1 wherein said array includes supports for said pixel elements perpendicular to the axes of rotation and said pixel element facets are supported from hubs passing through said supports, said hubs having an extension beyond said facets to act as a bearing against adjacent supports.

8. A sign as claimed in claim 1 wherein said array includes supports for said pixel elements perpendicular to the axes of rotation and leaf springs extending from said supports aligned with the axis of rotation of said pixel elements and said pixel element facets are supported from hub portions of said pixel elements, said hubs having a outer faces inward of said facets which are flat and contact said leaf springs to restrain said pixel elements from rotation.

9. A sign as claimed in claim 1 wherein said array includes supports for said pixel elements perpendicular to the axes of rotation and leaf springs extending from said supports aligned with the axis of rotation of said pixel elements, at least one of said leaf springs having portions integrally formed with similar portions of leaf springs for upper and lower ones of said pixel elements.

10. A sign as claimed in claim 9 wherein said supports for said pixel elements and leaf springs have aligned holes and further comprising axles for said pixel elements which pass through said aligned holes.

11. A sign as claimed in claim 1 wherein said array includes supports for said pixel elements perpendicular to the axes of rotation and leaf springs extending from said supports aligned with the axis of rotation of said pixel elements.

12. A sign as claimed in claim 1 wherein said array includes supports for said pixel elements perpendicular to the axes of rotation and leaf springs elements, said leaf springs having portions integrally formed with similar portions of leaf springs for laterally adjacent ones of said pixel elements.

13. A changeable sign display having an array of pixel elements rotatable about axes with facets selectively displayable in at least one of two modes and first and second ramp elements on said pixel elements opposed to said facets, comprising a movable activator bank located rearward of said pixel elements including ganged reset arms to reset all pixels to a common display and a solenoid bank having activatable solenoid rods to selectively contact ramp elements to set selected pixel elements to a selected display as said solenoid bank passes rearward of said pixel elements.

14. A sign as claimed in claim 13 wherein said movable activator bank includes a carriage supporting said ganged reset arms for selective pivoting between first and second positions, said first position being such that movement of said ganged arms resets said pixels and said second position being such that movement of said ganged arms does not reset said pixels.

15. A sign as claimed in claim 14 further comprising apparatus for pivoting said ganged arms from said first to said second position near one extreme of carriage travel and from said second to said first near the other extreme of carriage travel.

16. A changeable sign display comprising an array of pixel elements rotatable about axes with facets selectively displayable in at least one of two modes, thin, planar supports for said pixel elements perpendicular to the axes of rotation, and wires passing through said supports to serve as axles for said pixel elements and means for selectively rotating said pixel elements, wherein said wires are provided with sleeves between adjacent planar supports to space said supports from one another and to serve as bearings for said pixel elements.

17. A changeable sign display comprising an array of pixel elements rotatable about axes with facets selectively displayable in at least one of two modes. thin, planar supports for said pixel elements perpendicular to the axes of rotation, and wires passing through said supports to serve as axles for said pixel elements and means for selectively rotating said pixel elements, wherein said wires are secured to said planar supports to space said supports from one another and wherein said planar supports have upper and lower mountings and at least one of said mountings is adjustable to correct bowing of said planar support to assure sufficient coplanarity of said pixel elements to permit their selective rotation by said selective rotation means.

18. A changeable sign display having an array of pixel elements rotatable about axes with facets selectively displayable in at least one of two modes comprising a movable activator bank located rearward of said pixel elements and a motive means for said movable activator bank to move said bank to and fro rearward of said array of pixel elements to display selected pixel elements as said bank passes rearward of said pixel elements, wherein said motive means comprises a pair of pulleys on one end of said array, a shaft on the other end having a pair of spools fixed on said shaft and a motor to rotate said shaft, and a pair of cables, each having its two ends affixed to one of said spools, wraps around said spool, a fastening to said movable activator bank and a loop around one of said pulleys, whereby rotation of said shaft by said motor in a first direction pays out and retrieves cable from said spools to urge said movable activator bank to one end of said array, and rotation of said shaft by said motor in a second direction pays out and retrieves cable from said spools to urge said movable activator bank to the other end of said array.

19. A changeable sign display as claimed in claim 18 further comprising an electrical cable to said activator bank from a connection and a retriever for said electrical cable comprising a support across said array supporting a retriever pulley around which said electrical cable is trained, a smaller spool fixed on said shaft of a diameter less than the diameter of said spools of said pair, and a retriever cable having its two ends affixed to said smaller spool, wraps around said smaller spool, a fastening to said retriever pulley and a loop around said additional pulley, whereby rotation of said shaft by said motor in a first direction pays out and retrieves cable from said smaller spool to urge said retriever pulley from one end of said array to a central position and rotation of said shaft by said motor in a second direction pays out and retrieves cable from said smaller spool to urge said retriever pulley to the end of said array.

20. A changeable sign display as claimed in claim 18 further comprising a signal connection to said movable bank comprising a first optical transceiver at an end of said array and a second optical transceiver on said movable bank.

21. A changeable sign display as claimed in claim 18 further comprising an electrical power supply to said movable bank, said power supply having a connection to at least one of said cables and said spools being insulated from said power supply.

22. A changeable sign display as claimed in claim 18 further comprising an electrical power supply to said movable bank, said power supply having a connection to said bank through rails along which said bank travels.

23. A changeable sign display as claimed in claim 18 further comprising an electrical power supply to said movable bank, said power supply comprising a rechargeable battery on said bank and battery recharging connection at one end of said array to recharge said battery during periods when the sign is not being changed.

24. A changeable sign display having a. a supporting frame for an array of pixel elements including 1) planar supports for said pixel elements perpendicular to the axes of rotation and 2) leaf springs extending from said supports toward the axis of rotation of said pixel elements, at least one of said leaf springs having portions integrally formed with similar portions of leaf springs for upper and lower ones of said pixel elements and portions integrally formed with similar portions of leaf springs for a laterally adjacent one of said pixel elements, 3) wires passing through aligned holes in said supports and leaf springs to serve as axles for said pixel elements, and 4) sleeves around said wires between adjacent planar supports to space said supports from one another and to serve as bearings for said pixel elements 5) upper and lower mountings for said planar supports, at least one of said mountings being adjustable to correct bowing of said planar supports to assure sufficient coplanarity of said pixel elements to permit their selective rotation b. an array of acetal pixel elements rotatable about axes with facets selectively displayable in at least one of two modes wherein 1) said facets of said pixel elements are cylindrically concave, with the axis of the cylinder of concavity being parallel with the axis of the rotation for said pixel element, 2) first and second ramp elements on said pixel elements are provided opposed to said facets, 3) said facets are identical except for a label adhered to one of them, 4) said first and second ramp elements have different configurations so that the orientation of said pixel element may be determined by touch, 5) said pixel element facets are supported from a hub, said hub having a) flat outer faces which contact said leaf springs to restrain said pixel element from rotation, b) a slot extending along its length to permit said hub to be positioned over an axle support and c) an extension beyond said facets to act as a bearing against adjacent supports c. a carriage supporting a movable activator bank located rearward of said pixel elements including 1) ganged reset arms to reset all pixels to a common display, said ganged reset arms being mounted on said carriage for selective pivoting between first and second positions, said first position being such that movement of said carriage resets said pixels and said second position being such that movement of said carriage does not reset said pixels, 2) apparatus for pivoting said ganged arms from said first to said second position at one extreme of travel and from said second to said first at the other extreme of travel, 3) a solenoid bank having activatable solenoid rods to selectively contact ramp elements to set selected pixel elements to a selected display as said solenoid bank passes rearward of said pixel elements, and 4) a drive apparatus to move said carriage to and fro behind said array.

* * * * *